US006033253A

United States Patent [19]

Yi et al.

[11] Patent Number: 6,033,253

[45] Date of Patent: Mar. 7, 2000

[54] ELECTRICAL CONNECTOR WITH GUIDE AND LATCH

[75] Inventors: Chong Hun Yi, Mechanicsburg; John M. Spickler, Columbia; Kemper C. Walke, III, Harrisburg, all of Pa.

[73] Assignee: Berg Technology, Inc., Reno, Nev.

[21] Appl. No.: 08/838,902

[22] Filed: Apr. 11, 1997

[51] Int. Cl.[7] ..... H01R 13/64

[52] U.S. Cl. ..... 439/377

[58] Field of Search ..... 439/326, 260, 439/377, 630, 862, 66; 235/441

[56] References Cited

U.S. PATENT DOCUMENTS

| | | | |
|---|---|---|---|
| 4,161,346 | 7/1979 | Cherian et al. | 439/66 |
| 4,602,351 | 7/1986 | Shimamura et al. | 365/52 |
| 4,678,252 | 7/1987 | Moore | 439/62 |
| 4,773,877 | 9/1988 | Kruger et al. | 439/482 |
| 4,820,186 | 4/1989 | Fujii | 439/326 |
| 4,874,323 | 10/1989 | Shibano | 439/260 |
| 4,900,272 | 2/1990 | Lange et al. | 439/630 |
| 5,199,889 | 4/1993 | McDevitt | 439/66 |
| 5,297,966 | 3/1994 | Brennian, Jr. et al. | 439/64 |
| 5,425,651 | 6/1995 | Thrush et al. | 439/630 |
| 5,567,171 | 10/1996 | Mizuguchi | 439/630 |
| 5,603,629 | 2/1997 | DeFrasne et al. | 439/331 |

FOREIGN PATENT DOCUMENTS

| | | | |
|---|---|---|---|
| 0 333 530 B2 | 9/1989 | European Pat. Off. . | |
| 0 399 763 A2 | 11/1990 | European Pat. Off. . | |
| 0 688 067 A2 | 12/1995 | European Pat. Off. . | |
| WO 96/19854 | 6/1996 | WIPO | 31/8 |

*Primary Examiner*—Steven L. Stephan
*Assistant Examiner*—Barry M. L. Standig
*Attorney, Agent, or Firm*—Brian J. Hamilla; Daniel J. Long; M. Richard Page

[57] ABSTRACT

A connector for electronic elements with recessed contacts, such as flash memory cards, is disclosed. The connector enables substantially linear insertion of the card through a wall of an electronic component utilizing the card. A floating guide member receives the card and permits clearance movement toward and away from the connector contact terminals. A simplified form of compression connector is disclosed. It employs multiple point engagement of the terminal with the side walls of the terminal receiving passage to hold the contact terminals in the housing prior to installation.

31 Claims, 9 Drawing Sheets

ELECTRICAL CONNECTOR WITH GUIDE AND LATCH

BACKGROUND OF THE INVENTION

1. Field of the Invention

This invention relates to electrical connectors and specifically connectors for electrically associating portable, exchangeable electronic elements, such as integrated circuit cards, with a circuit substrate.

2. Brief Description of Prior Developments

User exchangeable electronic devices, particularly miniature integrated circuit cards known as compact flash cards, have been developed as user changeable memory or program sources for electronic cameras and other electronic components. One standardized card form comprises a miniature rectangular card having substantially flat top and bottom surfaces. The bottom surface carries an array of contact pads located in a recess formed near the front edge of the card. Power supply ($V_{CC}$) and ground contacts are incorporated into the leading edge of the card. The recessed array of contacts on the card presents a design difficulty. In order to prevent undue damage and wear to the contact elements of the card connector, it is desirable to avoid having the bottom front lip of the card engage the contacts. One approach to address this difficulty is exemplified in U.S. Pat. No. 4,820,186. The basic approach shown in this patent is to slide the card into a rotatable carrier and rotate the card against the connector contacts. A disadvantage of this approach is that it requires a substantial amount of surface area of the receiving component to be devoted to structure for receiving and rotating the card.

From the component manufacturer's standpoint, a more desirable approach is for the card to slide linearly into the component through a card receiving slot. A connector embodying such a linear sliding insertion action is shown in U.S. Pat. No. 4,874,323. However, the connector shown in this patent is relatively complex and has a number of moving parts. As a result, this connector would have a relatively high manufacturing cost.

The present invention provides a card connector that has a relatively simplified design, high reliability, and low manufacturing cost.

SUMMARY OF THE INVENTION

A connector according to the invention includes a floating frame for receiving an electronic element, such as a compact I/C card. The floating card receiving element is mounted on a base. As the card is moved in straight line fashion into the floating element, a transverse force is applied to the card and the floating carrier to position the card in contact with the contact terminals of the connector. Canted guides allow card removal by lifting the back end of the card.

The connector includes an array of compression type contact terminals arranged for sliding movement within a housing. A simplified connector structure results from use of a compressible contact terminal structure slidably received in a passage in the housing of the connector. The terminal is retained in the housing by a portion of the terminal that extends laterally beyond an edge of the contact passage and by multipoint frictional contact between the terminal and side walls of the passage receiving the terminal.

DETAILED DESCRIPTION OF THE PREFERRED EMBODIMENTS

The invention is described in the context of a connector for miniature I/C cards known as compact flash cards. However, the invention has applicability to other types of electronic devices having contacts disposed in a recess formed in a surface of the device.

Figure 1:
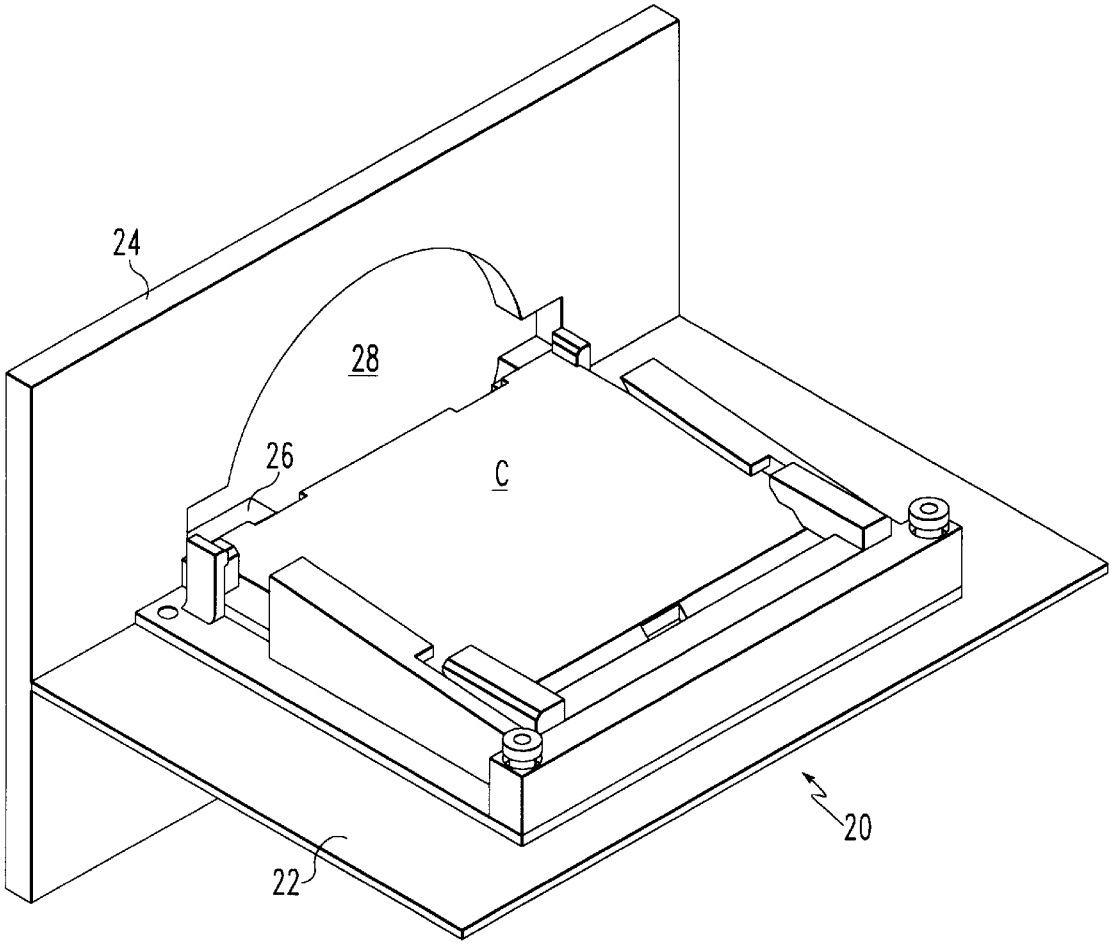
FIG. 1 is an isometric view of a card connector embodying the invention, showing the connector mounted for use in a component.

As shown in FIG. 1, the preferred embodiment of connector 20 is shown mounted on a circuit substrate 22, such as a conventional printed circuit board. The connector 20 is positioned on the board 22 so that it lies immediately adjacent a wall 24 of an electronic component with which a portable electronic device, such as a flash memory card, is to be used. A rectangular slot 26 is formed in the wall 24 so that the card can be passed through the wall. The wall 24 also includes an enlarged opening 28 to enable a user to grasp a card that has been inserted into the connector. A flash card C is mated with the connector.

Figure 2:
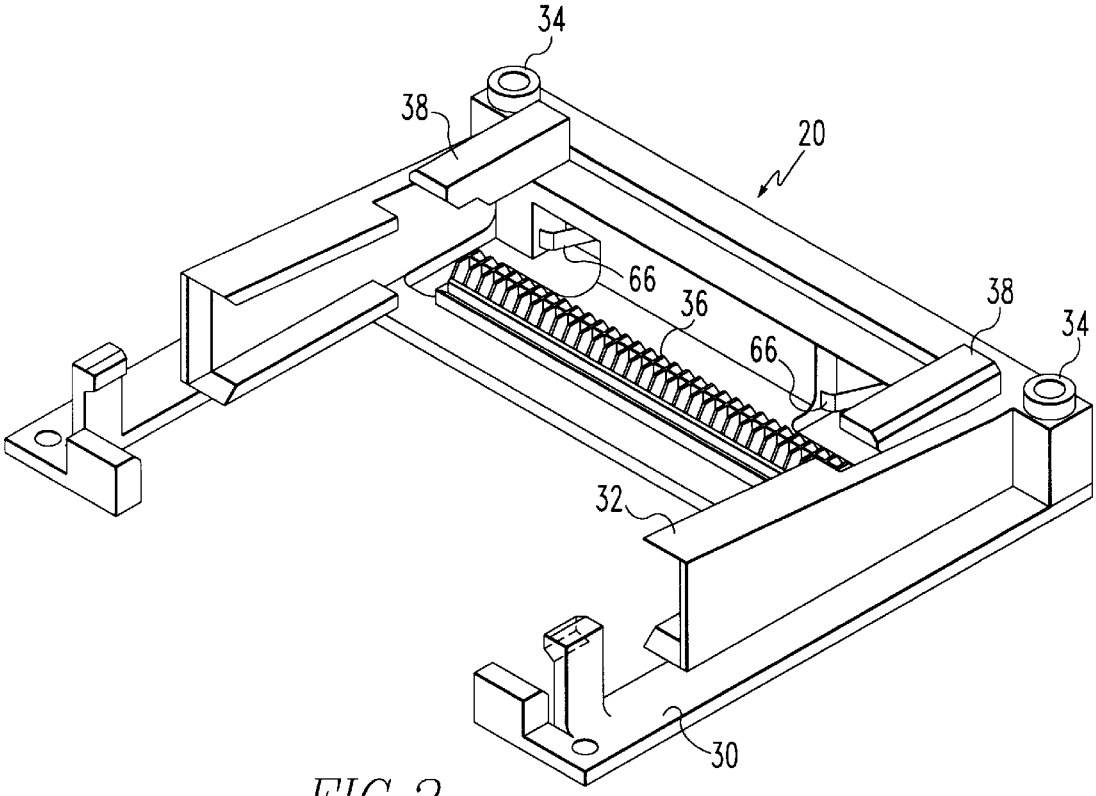
FIG. 2 is an isometric view of the connector shown in FIG. 1.

Referring to FIG. 2, the connector 20 comprises a base 30 and a floating guide member 32 movably mounted on the base by means of posts 34. A contact terminal housing 36 is associated with the base. The base 30, floating guide member 32 and contact housing 36 are preferably formed by molding an insulative polymer. The housing 36 is preferably formed separately from the frame 30 but may also be formed integrally therewith. As shown in FIG. 2, auxiliary contacts 66 are mounted in the base 30 to engage $V_{CC}$ and ground contacts that are specified to be present on the front edge of flash memory cards.

Figure 3:
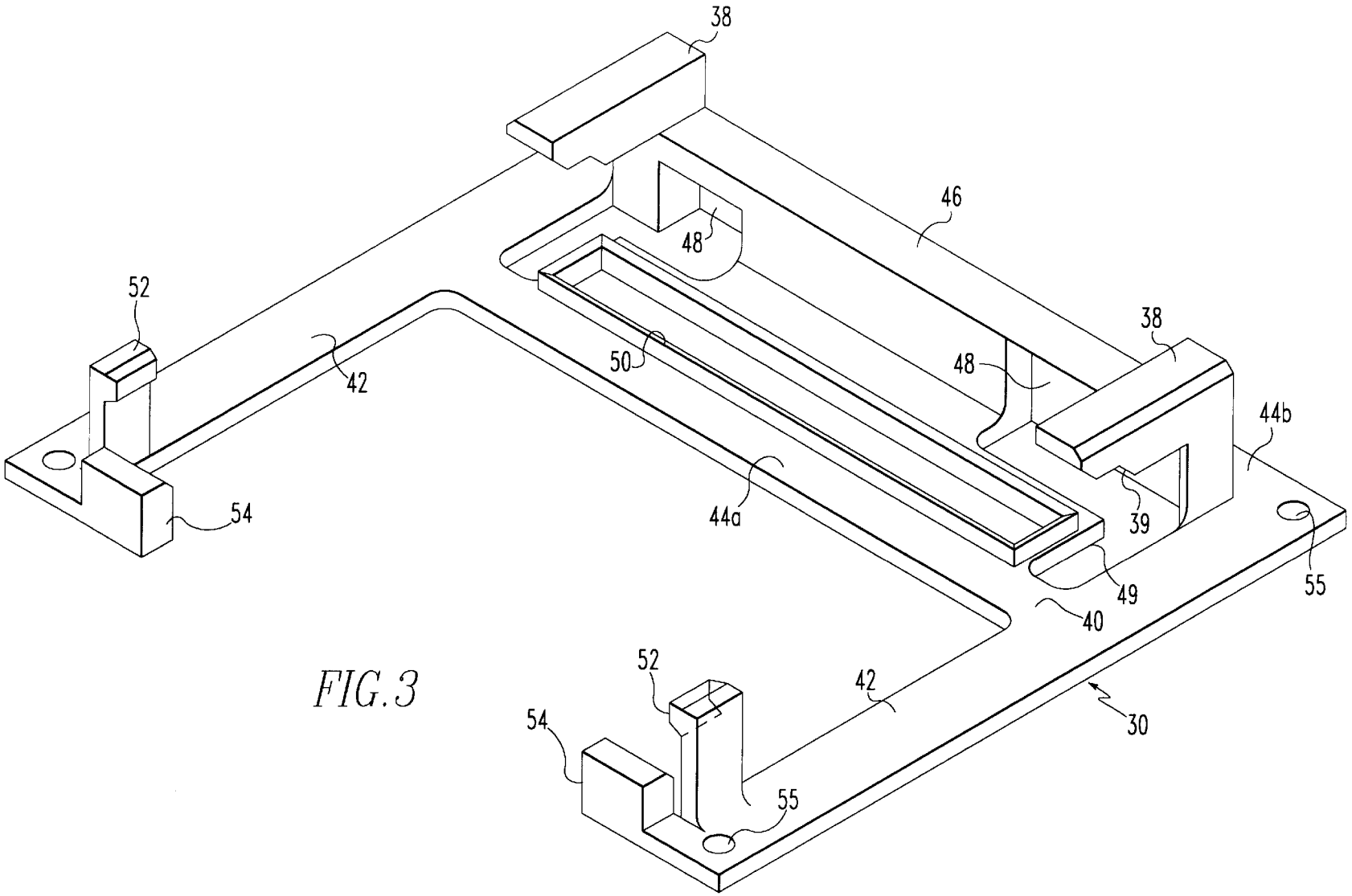
FIG. 3 is an isometric view of a base of the connector shown in FIG. 2.

FIG. 3 shows the base 30 in greater detail. The base 30 includes a frame 40 formed of two opposed frame sides 42 and two spaced cross members 44*a* and 44*b*. An upstanding transverse wall 46 is formed adjacent the rear end of the frame 40. A pair of cam blocks 38 are mounted on opposite ends of the top of the wall 46 and extend forwardly toward the front end of the frame. Cam blocks 38 include inclined cam surfaces 39 formed on lower surfaces of the cam blocks. Although the cam surfaces 39 are shown as flat, they could also be curvilinear. The back wall 46 includes recesses 48 for accommodating the auxiliary contacts 66 (FIG. 2). The frame 40 also includes a contact housing receiving portion 49 formed with an opening 50 that is sized to receive the contact housing 36.

At the forward end of the frame 40, an opposed pair of card latches 52 are integrally molded with the frame sides 42. An opposed pair of card stops 54 are positioned adjacent the latches 52 and, as shown, preferably are integrally molded parts of the frame 40. Mounting holes 55 are provided at each corner of the frame 40 to secure the connector on to a circuit substrate, such as circuit board 22 (FIG. 1).

Figure 4:
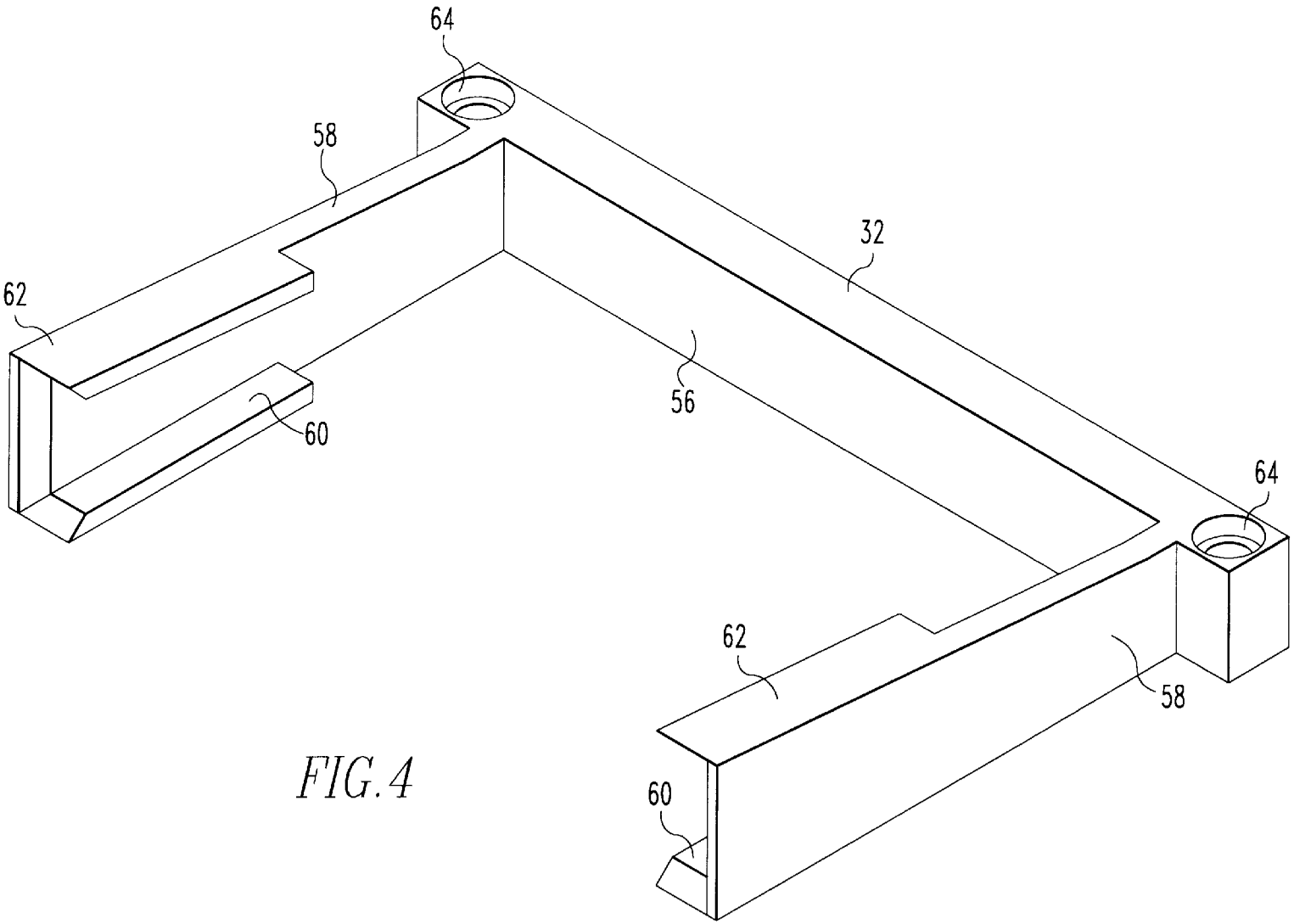
FIG. 4 is an isometric view of a card guide member of the connector shown in FIG. 2.
Figure 7A:
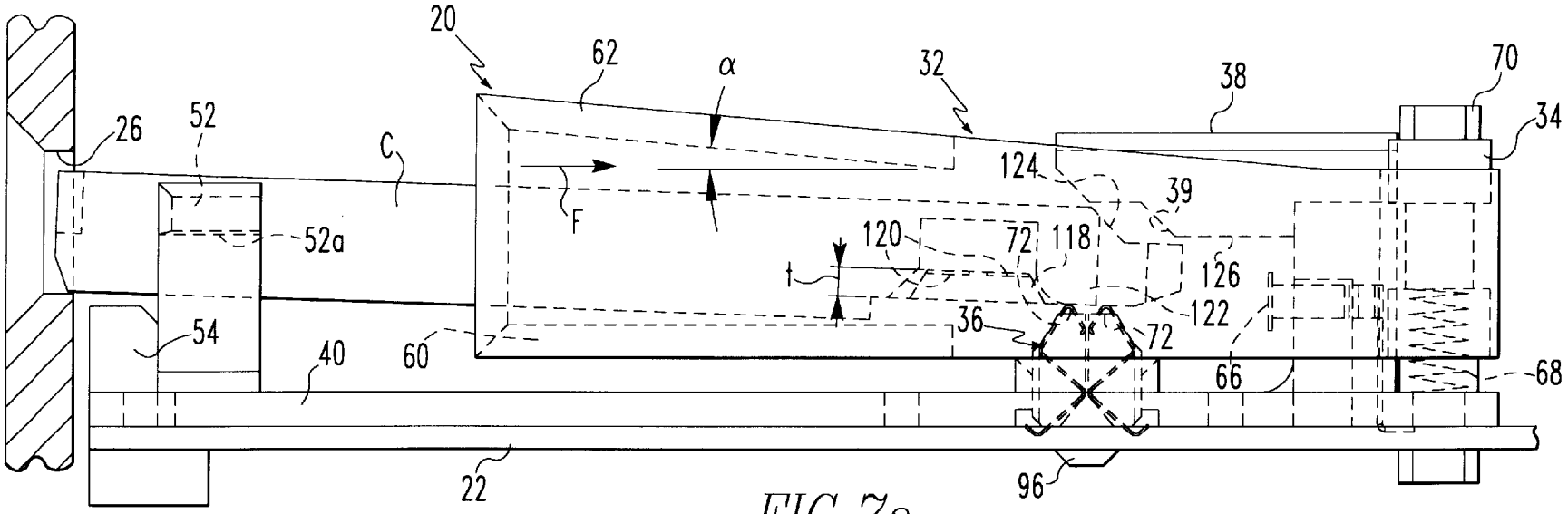
FIGS. 7*a, b* and *c* show three sequential steps of inserting a card into the connector of FIG. 1.

FIG. 4 shows features of the floating guide member 32. The guide member includes a cross bar 56 and two opposed, forwardly extending guide arms 58. The guide arms 58 each carry at their distal ends a pair of opposed guide rails comprising lower guide rails 60 and upper guide rails 62, forming facing channels. As shown in FIG. 7*a*, the lower guide rails are substantially parallel to the frame 40. The upper guide rails are canted by an angular amount represented by angle a in FIG. 7*a*, for reasons to be described later. Shouldered bores are disposed at each end of the cross member 56. The bores are sized to be slidably received on the bodies of the collared mounting pins 34 (FIGS. 1 and 2). The bores 64 are enlarged adjacent the top ends to receive the collars of the pins 34. The bores are also enlarged at the bottom ends to accept biasing elements, such as compression springs 68 (FIG. 7*a*). The posts 34 are fixed in position by fasteners, such as a machine screw and nut assembly 70, that is utilized to hold the connector 20 on to printed circuit board 22. By the arrangement just described, the guide member 32 is floatingly mounted with respect to the base 40, so that it is capable of moving toward and away from the base in a vertical direction in FIG. 7*a*. Compression spring 68 biases guide member 32 away from the frame 40.

Figure 5:
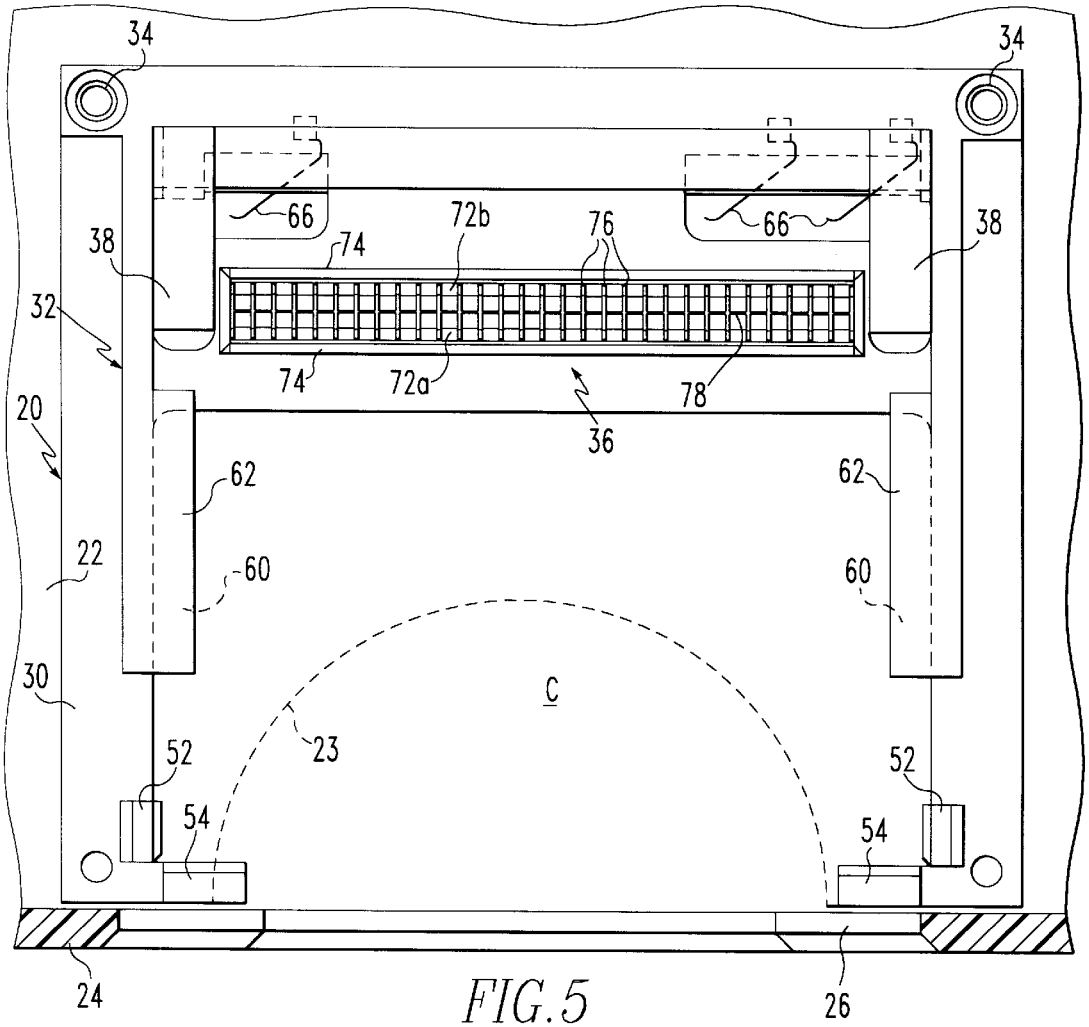
FIG. 5 is a plan view of the connector and the mounting arrangement shown in FIG. 1.

FIG. 5 is a plan view of connector 20 mounted in an electronic component. The connector 20 is mounted in alignment with the card slot 26 formed in the wall 24 of the component. The circuit board 22 includes an opening or relieved section 23 adjacent the slot 26. By relieving the circuit substrate 22 in this manner, a user can grasp upper and lower surfaces of the card C by inserting fingers through the opening 28.

Figure 6:
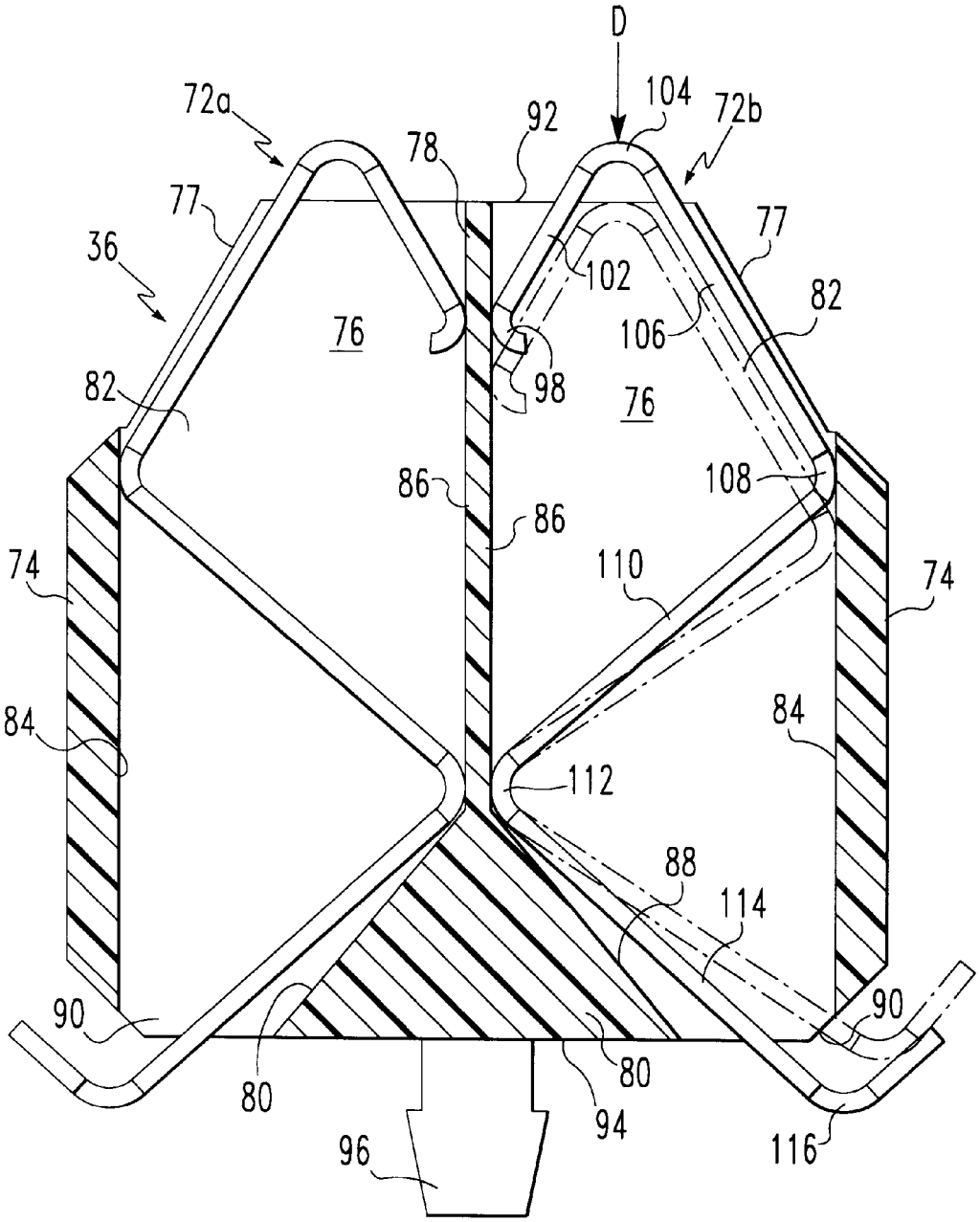
FIG. 6 is a cross sectional view of a contact terminal housing and contact terminals used with the connectors shown in FIG. 1.

In FIG. 2, the contact terminal housing 36 is illustrated without contact terminals, in order to simplify the drawing. FIG. 6 shows, in cross section, a preferred form of contact housing 36 and contact terminals 72*a*, 72*b*. The housing 36 comprises a longitudinally extending body having opposed sides 74 and a plurality of transverse walls 76. The housing also includes a substantially centrally located longitudinally extending center wall 78. The wall 78 is flared outwardly toward the side wall 74 by the flared section 80 at the bottom of the housing. By this construction, a series of opposed passages 82 are formed to receive contact terminals. The passages 82 include substantially straight smooth first side walls 84 and substantially straight smooth second side walls 86. The walls 84 and 86 are substantially parallel. At the lower end of each passage, angled surfaces 88 are formed by the flared section 80. A transversely extending opening 90 is formed along the bottom edge of each side wall 74. The terminal housing 36 forms a mating interface 92 for mating with the card and a mounting interface 94 for mounting on a circuit substrate. A hold-down and locating peg 96 projects from the bottom of the housing 36 to retain the housing on a circuit substrate.

The upper portions of transverse walls 76 extend above sides 74 and are provided with angled side edges 77. Edge 77 provides a lead-in surface for the card C so that, for example, if engaged by the front edge of the card during insertion, the card will be directed upwardly over the housing 36. The edges 77 also provide protection for the contact terminals 72 during movement of the card C into and out of the connector 20.

Pairs of contact terminals 72*a* and 72*b* are disposed in opposed passages 82. As shown in FIG. 6, these contact terminals are substantial mirror images of each other. Therefore, only contact terminal 72*b* will be described in detail. The contact terminal 72*b* includes a radiused or bent section 98 that is biased against the surface 86. A first leg 102 extends from the section 98 to a contact section formed by the bend 104. A second leg 106 extends from the contact section 104 to an upper bend 108. The outer surface of the bend 108 engages wall 84 of the side 74. A third leg 110 extends from the upper bend 108 to the lower bend 112. As shown, the outer radiused surface of the bend 112 is adjacent the junction of the surfaces 86 and 88. A fourth leg 114 extends from the bend 112 to a circuit substrate engaging contact 116. In the illustrated embodiment, when the housing 36 is mounted on a substrate and retained by the hold-down peg 96, the fourth leg 114 is deflected to the dotted line position. This deflection creates a spring force that presses the contact bend 116 against a contact pad, (not shown) on the circuit board. Alternatively, the contact pad 116 may comprise a surface mount solder tail, rather than a compression connection as shown.

As illustrated, the housing 36 and terminals 72*a*, 72*b* form a compression connector so that, as a compressive force in the direction of arrow D is applied to the contact terminals, the terminals telescope into the passages 82. As the terminals telescope, they also bend in the regions 108 and 112, resulting in deflection principally of the cantilevered legs 106 and 110, which thereby develop spring forces to create a normal force to press the contact section 104 against a contact pad. The surface 88 resists axial movement of the terminal 72*b* along the passage and thus stabilizes the location of the bend 112. As previously described, the circuit board contact portion 116 extends laterally through the opening 90 in a transverse direction beyond side 74. Thus, when the housing 36 is mounted on a substrate, the terminal is prevented from moving axially out of the passage 82 by the side wall 74. Also, when the terminals are inserted into the passages, the legs 102 and 106 are deflected about bend 104 in a manner to create a spring pre-load against the walls 84, 86. Thus, the bends 98, 108 and 112 , provide multipoint frictional contact within the passages to retain the terminals in the housing 36 prior to mounting.

Figure 7B:
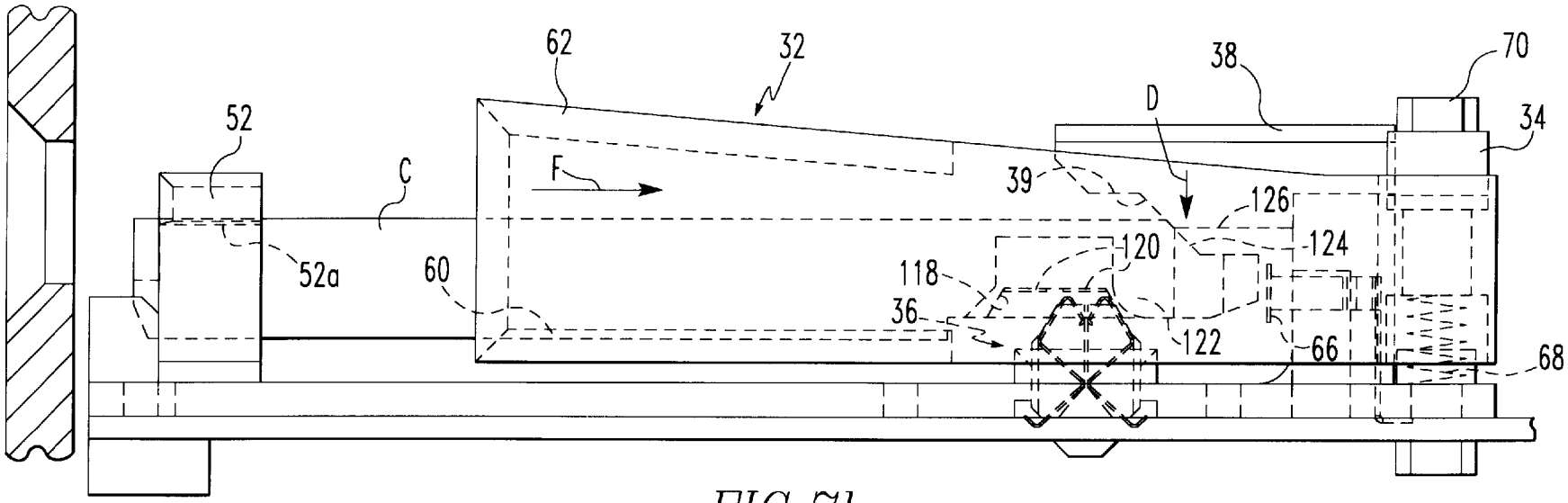
Figure 7C:
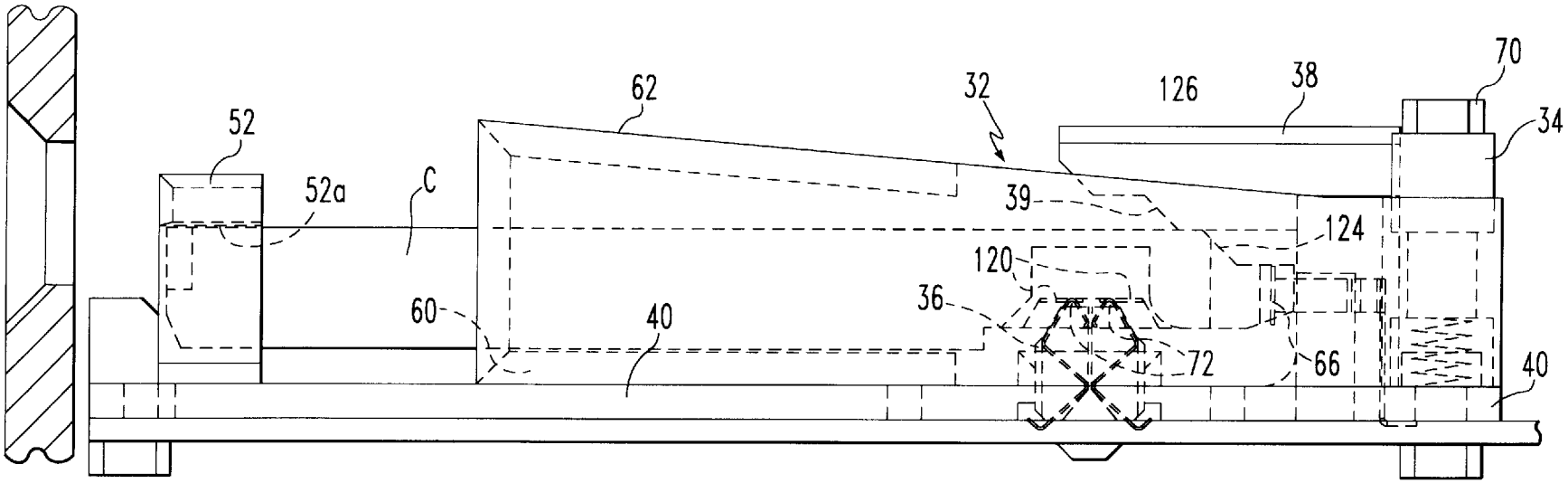

FIGS. 7*a*, 7*b* and 7*c* illustrate the mating sequence of card C with the connector 20. FIG. 7*a* shows the card C in an initial position after insertion through the slot 26 of component wall 24. In this situation, the card is being moved forwardly in the direction of arrow F and is guided substantially by the lower guide rail 60 in a forward direction. The lateral side edges of the card deflect the latches 52 as the card is inserted. The card C has a recess 118 along a bottom front edge of the card. An array of contact pads 120 is disposed in the recess 118. The contacts are spaced a distance t from the lower front surface of the card. The recess 118 forms a front lip 122 that must be cleared before contact is established between the contact terminals 72 and the contact pads 120. As shown, the card C includes an angled surface 124 along the top edge of the card. Each of the cam blocks 38 includes a camming surface 39 and a lower latching surface 126.

FIG. 7*b* illustrates an intermediate stage of the mating sequence in which the user continues to impart an insertion force in the direction of arrow F on the card C. In this position, the inclined surface 124 on the front edge of the card has engaged the camming surface 39 of the cam block 38. Also, at this stage, the front edge of the recess 118 has cleared the connector housing 36. As a result of the engagement of the surface 124 with the cam surface 39, the card C and guide frame 132 move downwardly toward base 40 to compress springs 68.

FIG. 7*c* illustrates the final mating position of the card C in the connector. At this stage, the inclined surface 124 of the card C has moved beyond the cam surface 39 and the front edge of the card is latched by the lower latching surface 126. The recess 118 is aligned with the terminal housing 36 and the contacts 72 have been telescoped within passages 82 to develop contact forces to engage the contact pads 120 of the card. The guide member 32 has fully compressed the springs 68 and is positioned substantially against the frame 40. The rear end of the card C has passed beneath the latching surfaces 52*a* of the latches 52 and the rear end of the card is thereby held in vertical position. Also, in this position, the auxiliary contacts 166 are deflected and engage the power supply ($V_{CC}$) and ground contact pads disposed along the front edge of the card. The card stops 54 prevent the card from moving rearwardly, out of the connector.

To remove the card, the user grasps the back end of the card through the opening 28 and rotates or rocks the card upwardly toward the guide surface 62, thereby deflecting the latches 52 and clearing the card stops 54. This upward rotation about the front edge of the card is permitted by reason of the canting of the upper guide rail 62. In this position, the card is free to move rearwardly so that it is free of the lower latching surface 126 of cam block 38 thereby allowing removal of the card rearwardly through the slot 26.

The arrangement described provides for substantial linear insertion of the card C through a slot in the side wall of a component it also provides protection for the contact terminals of the connector, so that the card insertion and removal cycle can be repeated many times without damage to the connector contacts. The connector also minimizes the number of parts thereby simplifying construction and assembly of the connector and lowering manufacturing costs.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector for electrically connecting an electronic element with a circuit substrate comprising:

a base;

a guide member for guiding the movement of the electronic element along an insertion path;

mounting structure mounting the guide member on the base;

an electrical contact terminal on the base;

structure on the base and engageable by the electronic element for moving the guide member toward the contact terminal in response to movement of the electronic member along the guide member in said insertion path; and a latching member for holding the electronic element in a contact engaging position with the contact terminal.

2. An electrical connector as in claim 1, wherein the latching member is disposed along a lateral side edge of said insertion path.

3. An electrical connector as in claim 1, wherein the guide member is configured to receive a portable electronic element with at least one major surface having a recessed region and a plurality of contacts disposed in the recess.

4. An electrical connector as in claim 1, wherein the insertion path is substantially parallel to the base.

5. An electrical connector as in claim 1, wherein the structure comprises a cam surface angled relative to the insertion path.

6. An electrical connector as in claim 5, wherein the cam surface is part of the base.

7. An electrical connector as in claim 1, wherein the guide member includes a first guide rail and a second guide rail angled relative to the first guide rail.

8. An electrical connector as in claim 7, wherein the first guide rail is disposed a distance from the base that is less than a distance from the second guide rail to the base.

9. An electrical connector as in claim 1, wherein the mounting structure allows movement of the guide member from an insertion position located away from the contact terminal to an engagement position located adjacent the contact terminal.

10. An electrical connector as in claim 9, wherein the base has a flat surface for mounting on the substrate and the guide member moves generally perpendicular to the flat surface.

11. An electrical connector as in claim 9, wherein the guide member abuts the base in the engaging position.

12. An electrical connector as in claim 9, wherein the mounting structure includes a resilient element engaging the guide member and the base for biasing the guide member towards the insertion position.

13. An electrical connector as in claim 12, wherein the guide member is positioned a distance from the base in the insertion position that is greater than a distance between the guide member and the base in the contact engaging position.

14. An electrical connector for connecting an electronic element to a circuit substrate comprising:

a base adapted to be mounted on a circuit substrate;

a guide member for guiding movement of the electronic element along an insertion path;

a plurality of electrical contact terminals associated with the base and defining a mating plane;

mounting structure allowing the guide member to move in a direction transverse to the mating plane defined by the contact terminals between a first position and a second position;

a resilient element biasing the guide member to said first position; and a cam surface engageable by the electronic element during movement along the insertion path to move the guide member to said second position.

15. A connector as in claim 14, wherein the guide member includes a first member for guiding the electronic element during insertion along a path substantially parallel to the circuit substrate and a second member angled relative to the first member.

16. A connector as in claim 14, wherein the guide member comprises a pair of opposed guide channels and a cross member joining the guide channels.

17. An electrical connector as in claim 14, wherein the guide member moves generally perpendicular to the mating plane.

18. An electrical connector as in claim 14, wherein said cam surface is part of said base.

19. An electrical connector as in claim 14, wherein the guide member abuts the base in the engaging position.

20. An electrical connector as recited in claim 14, further comprising a latch positioned to engage the electronic element to hold the guide member adjacent the contact terminals.

21. A connector as in claim 14, and further comprising a contact terminal mounted to the base, said plurality of contacts being disposed in the housing.

22. A connector as in claim 21, wherein the housing is separable from the base.

23. A connector as in claim 22, wherein the base includes an opening for receiving the housing.

24. An electrical connector comprising:

a housing defining a mating interface and a mounting interface;

a contact terminal receiving passage in the housing extending from the mating interface and having a first side wall and an opposed second side wall having an angled portion located adjacent the mounting interface;

a contact terminal positioned in the passage, the contact terminal comprising an elongated body having:

a first portion engaging the first side wall;

a second portion, longitudinally spaced from the first portion, engaging the second side wall;

a third portion, longitudinally spaced from the second portion, engaging the first side wall;

a mating interface section adjacent one end of the Passage and located between said first and second portions; and a substrate engaging section extending from a second end of the passage laterally beyond one of the opposed sides of the passage.

25. An electrical connector as in claim 24, wherein the second sidewall is substantially straight and the angled portion comprises a portion of the wall sloped toward the opposite side of the passage.

26. An electrical connector as in claim 24, wherein the housing includes a lateral opening located at the mounting interface of the housing beyond which the substrate engaging section extends.

27. An electrical connector as in claim 24, wherein the walls of the passage include substantially straight, parallel portions and the contact terminal is compressibly resilient and collapsible along a longitudinal axis into the passage.

28. An electrical connector as in claim 19, wherein the contact terminal is adapted to engage a lower surface of an electrical component.

29. An electrical connector as in claim 24, wherein the first, second and third portions frictionally retain the contact terminal in the passage.

30. An electrical connector as in claim 24, wherein the contact terminal comprises a compressively resilient member collapsible into the passage.

31. An electrical connector as in claim 30, wherein the contact terminal includes at least two mutually cantilevered arms extending from a bend, said bend comprising one of the portions of the contact terminal.

* * * * *